United States Patent [19]

Brown

[11] 4,135,294

[45] Jan. 23, 1979

[54] WINDING A MULTI-PANCAKE MAGNET FROM A CONTINUOUS CONDUCTOR

[75] Inventor: Robert L. Brown, Kingston, Tenn.

[73] Assignee: The United States of America as represented by the United States Department of Energy, Washington, D.C.

[21] Appl. No.: 889,665

[22] Filed: Mar. 24, 1978

[51] Int. Cl.[2] ..... H01F 41/06

[52] U.S. Cl. ..... 29/605; 242/7.03; 336/205; 336/207

[58] Field of Search ..... 29/605; 242/7.03, 7.07; 336/205, 207, 208

[56] References Cited

U.S. PATENT DOCUMENTS

| | | | |
|---|---|---|---|
| 1,955,318 | 4/1934 | West et al. | 336/207 X |
| 2,982,889 | 5/1961 | Whearley | 29/605 X |
| 3,467,931 | 9/1969 | Dutton | 29/605 |

*Primary Examiner*—Carl E. Hall

*Attorney, Agent, or Firm*—Dean E. Carlson; Stephen D. Hamel; Louis M. Deckelmann

[57] ABSTRACT

A magnet winding method is provided wherein the individual pancakes are fabricated such that adjacent pancakes have oppositely spiraled grooves that begin and end at the same relative locations on the pancakes. Holes through the pancakes are provided at each end of the spirals that permit winding the entire magnet without a single splice.

6 Claims, 4 Drawing Figures

WINDING A MULTI-PANCAKE MAGNET FROM A CONTINUOUS CONDUCTOR

BACKGROUND OF THE INVENTION

This invention was made in the course of, or under, a contract with the United States Department of Energy.

Large superconducting magnets are beginning to be used in such fields as nuclear physics, large-scale energy storage, and controlled thermonuclear fusion research. Many parameters, such as operating current, stored energy, and cryostatic stability (to name only a few), influence the various magnet designs.

In applications such as the poloidal field system and the toroidal field coils of superconducting tokamaks, magnets are required that must withstand large pulsed magnetic fields. Magnets that are wound in the pancake configuration are generally preferred for these applications because of their superior mechanical properties. However, since splices between the pancakes have always been required, the layer-wound types have most often been chosen. Since the layer-wound coils have a disadvantage in supporting magnetic forces, catastrophic failures are still occasionally experienced with these magnets.

Furthermore, in any coil whether superconducting or normal room temperature, it is beneficial to keep splices to a minimum. Splices often have contact resistance, reduced strength in tension, increased cooling problems, and consume time and labor in their fabrication. Therefore, the need exists for a method of winding multiple pancake coils from a continuous superconductor cable. The present invention was conceived to meet this need in a manner to be described hereinbelow.

SUMMARY OF THE INVENTION

It is the object of the present invention to provide a method and means for making and winding multiple pancake coils of a magnet from a continuous superconductor cable, to thus provide a magnet without any splices.

The above object has been accomplished in the present invention by providing a plurality of machined or molded plates, designated A, and a plurality of machined or molded plates, designated B, for subsequent stacking and winding into the desired multi-pancake magnet coil. A large hole is provided in each plate for the coil bore, and a radially-spiraling groove is milled in one side of each plate for receiving the conductor. The respective plates A and B differ in that the conductor groove in each of the A plates spirals radially inward (e.g., from a point near the outer perimeter to a point near the bore), and the groove in each of the B plates spirals radially outward, beginning at the corresponding point near its bore to a point near its outer perimeter that corresponds to the beginning point on the A plate. Preferably, the inner and outer points that correspond to the ends of the spirals are located 180° from each other (measured from the coil axis). Two short slots are machined through each plate at the two end points of each spiral groove which are utilized as crossovers for the conductor to pass from one pancake to the next in a manner to be described hereinbelow. Two cover plates (end plates) that are without conductor grooves complete the magnet, and each of the interior plates A and B and cover plates of the magnet are provided with a plurality of predrilled holes parallel to the coil axis and at matching locations in each plate. These holes are slightly larger in size than the cross section of the conductor thus enabling a suitable coolant to flow from one end wall (plate) of the coil to the other end wall across the conductor windings.

DESCRIPTION OF THE PREFERRED EMBODIMENT

Figure 1:
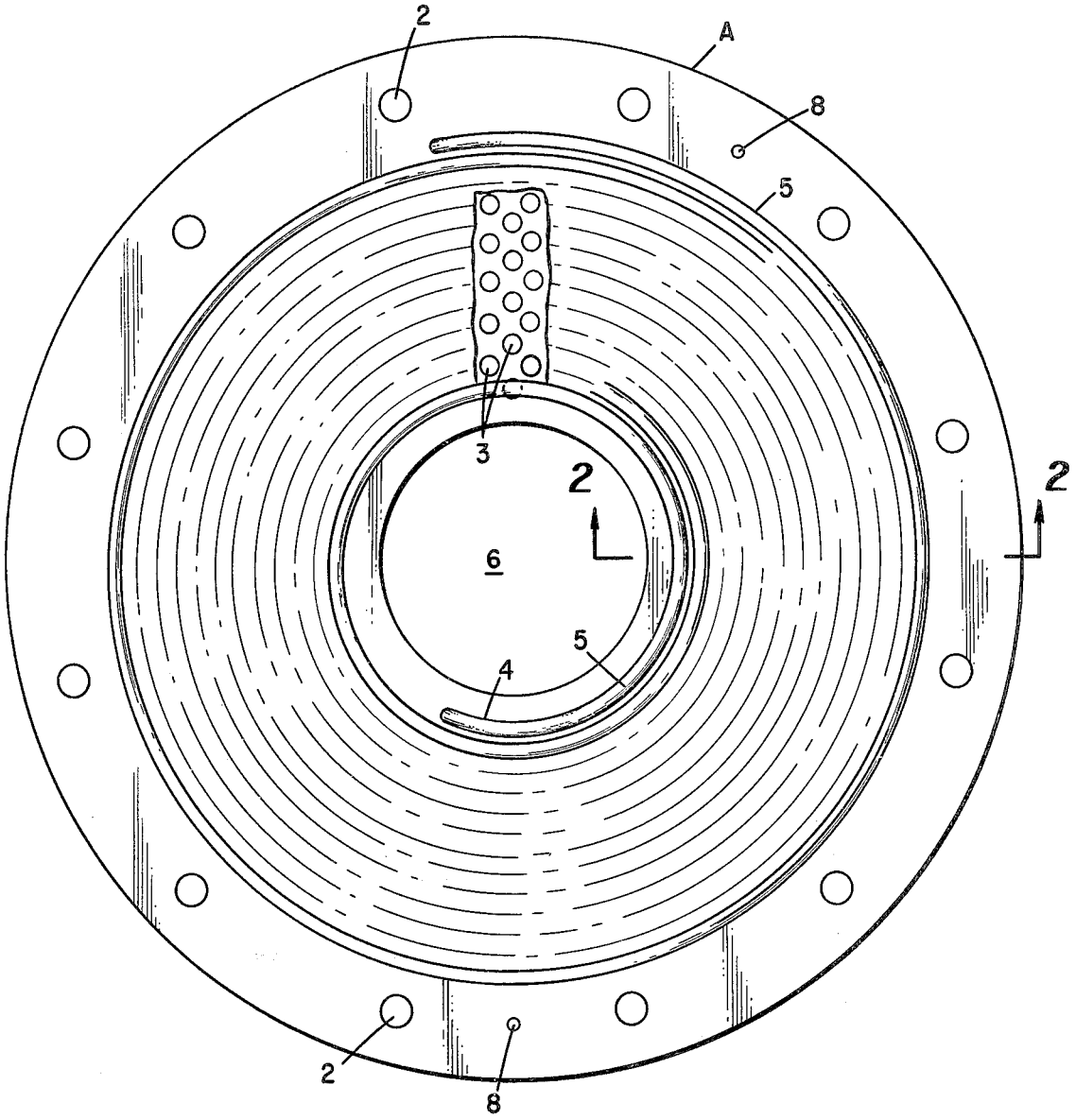
FIG. 1 is a top view of a typical pancake plate, designated A, utilized in the winding method of the present invention.
Figure 2:
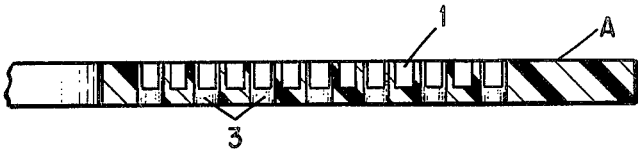
FIG. 2 is a sectional view along the line 2—2 of FIG. 1.
Figure 3:
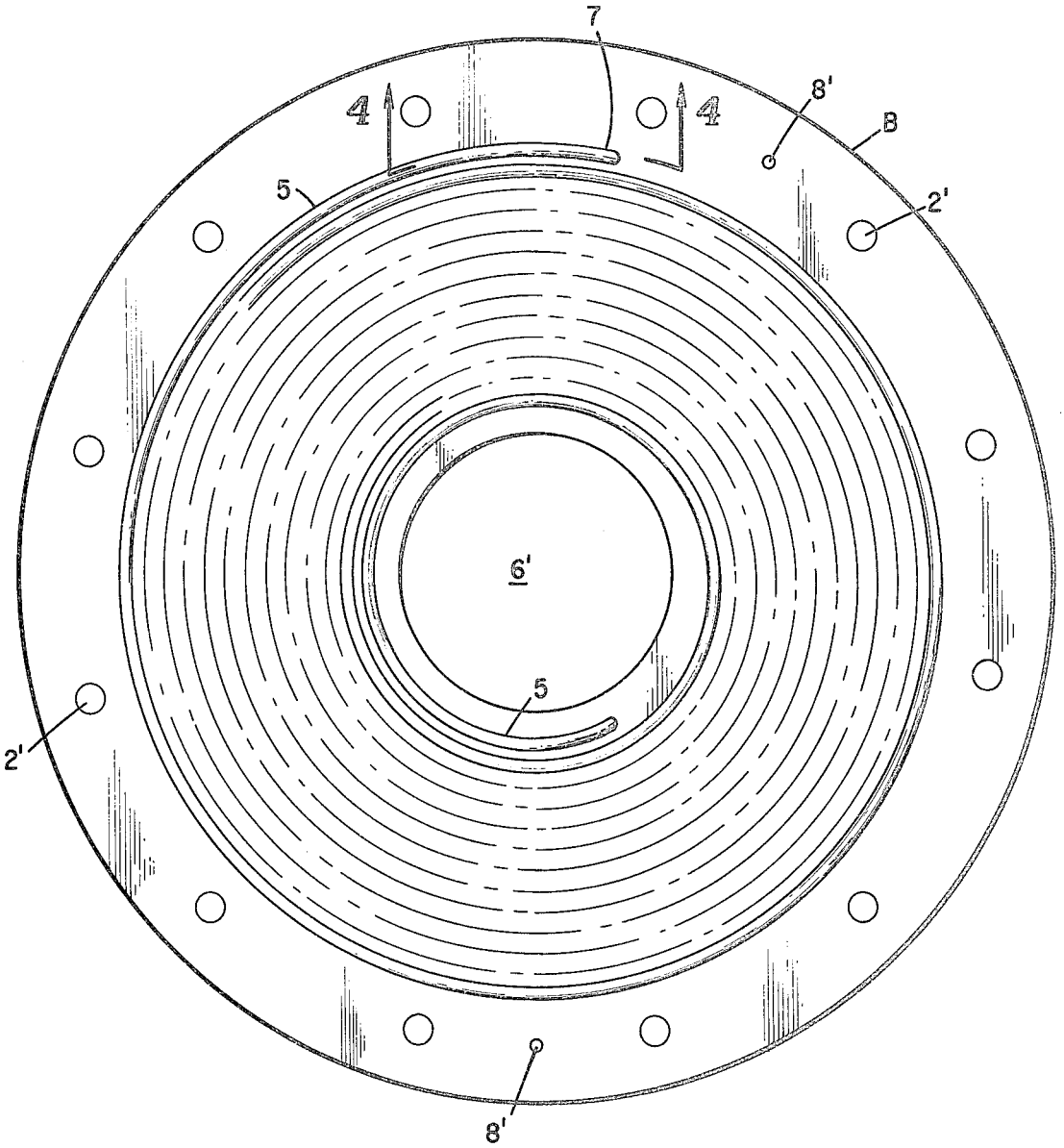
FIG. 3 is a top view of a typical pancake plate, designated B, utilized in the winding method of the present invention.

A plurality of plates, designated A, and a plurality of plates, designated B, are machined or molded for subsequent stacking and winding into a desired multi-pancake magnet coil. FIG. 1 illustrates a typical A plate and FIG. 3 illustrates a typical B plate. A large hole (6 in FIG. 1 and 6' in FIG. 3) is formed in each plate for the coil bore. A radially-spiraling groove 1, as more clearly illustrated in the sectional view of FIG. 2, is milled in one side of each of the plates A and B for receiving the conductor 5 of the coil during the winding process. The A and B plates differ in that the conductor groove 1 in each of the A plates spirals radially inward (e.g., from a point near the outer perimeter to a point near the bore), and the groove in each of the B plates spirals radially outward, beginning at the corresponding point near its bore to a point near its outer perimeter that corresponds to the beginning point on the A plate. Preferably, the inner and outer points that correspond to the ends of the spirals are located 180° from each other (measured from the coil axis).

Since the conductor 5 is to be without splices, crossovers must be provided not only at the bore of each pancake (plate), but also at the outer perimeter where the conductor passes from one pancake to the next. Both crossovers are made in the same way. Two short slots are machined through each plate at the two end points of each spiral groove. The slots permit the conductor to rise out of the plane of the previous plate and into the plane (and the groove) of the next plate where it can continue to be wound in the same direction (but opposite spiral) in the next plate. In other words, the grooved sides of all the plates will face in the same direction in the finished magnet. The length of the magnet is determined by the number of pancakes that are stacked together, and two cover plates (end plates), not shown, that are without conductor grooves complete the magnet. The end plates are each provided with a suitable hole for threading the conductor therethrough for the purpose to be described hereinbelow.

Figure 4:
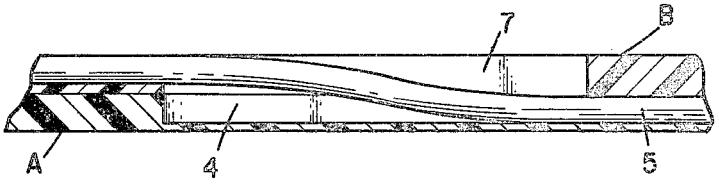
FIG. 4 is a sectional view along the line 4—4 of FIG. 3, illustrating how the conductor crosses over from one pancake plate to the next pancake plate.

A pair of typical, aligned crossover slots are illustrated in the sectional view of FIG. 4, wherein the crossover slot 7 of FIG. 3 and the crossover slot 4 of FIG. 1 are more clearly shown. It can be seen in FIG. 4 that the conductor 5, which was previously wound onto the A plate, rises in the aligned slots 4 and 7 to then be pressed into the spiral slot of the B plate as described below. After the conductor 5 is wound onto the B plate in the spiral groove thereof, then the conductor rises through the aligned slots of the B plate and the next A plate, not shown, except in the latter case the conductor 5 rises up in the opposite end of the slot to then be press fitted into the next A plate.

It should be noted that the sectional views of FIGS. 2 and 4 are shown enlarged for the sake of clarity.

The respective A and B plates are provided with suitable holes 2, 2', and also the end plates, not shown, are also provided with suitable matching holes to facilitate the insertion of bolts therethrough to clamp all of the plates together after the winding operation is completed. Also suitable dowel holes 8, 8' are provided in each of the respective plates A and B such that by means of dowel pins each plate is maintained in proper stacked relationship with the preceding plate during the winding process.

To provide for pool boiling for cooling the finished magnet during operation thereof, a plurality of small, predrilled holes 3 are machined through each of the plates A and B parallel to the coil axis, as illustrated in FIGS. 1 and 2 of the drawings, and at matching locations in each plate. These holes are slightly larger in size than the cross section of the conductor 5, thus enabling the coolant to flow from one side (end) wall of the coil to the other wall across the conductor windings. The number and shape of the cooling passages through the plates would depend on the particular requirements of the coil. It should be understood that the interior of the finished coil magnet can be coupled to an external source of a coolant in a conventional manner. It should be understood that, alternately, the coil of present magnet could be cooled by forced coolant circulation, if such is desired.

The method of winding of the pancakes (respective plates A and B) of the present invention will now be described. All of the conductor is initially on a supply spool. Before winding, the conductor is threaded through the above-mentioned hole in the top cover plate, through the proper inner or outer crossover slot in each of the respective B and A plates, and then through the hole in the bottom cover plate. The top cover plate, which is threaded onto the conductor first, is followed by a B plate, then an A plate, a B plate, etc., until all of the plates are threaded including the bottom cover plate. It is convenient to clamp the plates together near the supply spool, away from the winding table.

The winding table is a conventional flat table, adapted for motorized rotation in a horizontal plane, and having clamps or bolts for holding the plates in place as they are stacked and wound with conductor. The bottom cover plate and the first A plate are brought to the winding table initially and are clamped in place. The conductor, which is preferably (though not necessarily) a braided rectangular conductor, is pressed into the milled groove in the A plate beginning at the outer perimeter.

During the winding, the table is rotated slowly so that the conductor always approaches the groove tangentially and can be pressed in the groove (usually a snug fit) with relative ease. When the spiral groove in the A plate has been filled with conductor, the table motion is stopped and a B plate is removed from the stacked plates and brought along the conductor to the already wound A plate for clamping in place on top of the A plate. When the B plate is in place, the conductor will protrude through the inside crossover slot of the already wound A plate and through the inside crossover slot of the B plate. The table rotation can then be restarted and the winding continued in the same tangential direction as before with the conductor now being pressed into the spiral groove of the B plate.

When the outside slot of the B plate is reached, two pancakes have effectively been wound, but the winding operation is not complete at this point. A new pancake is started by bringing the next A plate to the table along the conductor and clamping it on top of the wound B plate. As was the case for the inner slot of the B plate, the conductor now protrudes through the outer slot of the B plate and the outer slot of the A plate which is now on top of the B plate, and when the table is rotated again, the conductor can continue to be wound in the spiral groove of the second A plate. When all of the plates have been stacked and wound in the above manner and the top cover plate is in position on top of the last wound plate, bolts are inserted through the plates to clamp them all together. The two conductor ends extending out from the two cover plates then become the electrical leads of the finished magnet.

The conductor 5 utilized in the above-described winding method can, of course, be either a conventional copper conductor or a superconducting conductor depending upon the end use of the magnet. To increase plate strength at the conductor and reduce machining, two or more conductors may be wound-in-hand and placed in the properly sized spiral grooves of the respective plates during the winding process. If insulation is desired between conductors, or if extra cooling is needed, a porous epoxy B-stage insulation strip may also be included between conductors. A heat cure of the finished magnet will bond the conductors to the insulation strip, thereby making them stiffer.

The above-mentioned snug fit of the conductor everywhere along its length in the grooves will considerably reduce conductor movement, give strength where it is needed most, and provide distributed structural reinforcement. Where conductor movement or forces are not a problem, an alternative design would be to fabricate a single large recess in the plate instead of grooves, thereby permitting maximum packing of the conductor in each of the single recesses.

In general, a magnet operated in the steady-state mode is much more reliable than a pulsed magnet that is forced to undergo hundreds or thousands of thermal and mechanical stress fatigue cycles. Since the above-described winding method eliminates the splice resistance, prevents conductor motion, and can provide for adequate liquid helium cooling, it is particularly suited to pulsed magnets and magnets subjected to large pulsed magnetic fields. Extra diameter may be added to the outer perimeter of each plate, beyond the grooved region, if necessary, to contain high radial forces.

If the plates of the magnet need to be fabricated from a nonconducting material in order to minimize eddy-current losses, a ceramic or a reinforced polycarbonate plastic such as Lexan may be used to fabricate the plates. In magnets where eddy currents are not a problem, the plates can be made of metal for strength or economy and could incorporate film insulation.

It should be understood that the present invention is not limited to the plates that have a circular configuration as shown in FIGS. 1 and 3 of the drawings. For example, the above-described winding method can also be utilized for winding noncircular magnets such as those that have been envisioned for the toroidal field coils of various future tokamaks.

It can be seen from the above described winding method, a magnet is provided with a continuous conductor, thus eliminating any splices that were heretofore required in winding multi-pancake magnets.

This invention has been described by way of illustration rather than by limitation and it should be apparent that it is equally applicable in fields other than those described. For example, the magnets provided by the above-described method can be utilized as large-scale energy storage devices.

What is claimed is:

1. A method of making and winding a multi-pancake magnet from a continuous conductor comprising the steps of forming a large hole in a first set of plates for the coil bore of said magnet, sequentially machining one side of each of said plates with an inwardly, radially-spiraling groove extending in a clockwise direction from a point near the outer perimeter of each plate to a point near said bore, machining a short crossover slot through each of said plates at the two end points of each of said spiral grooves, forming a large hole in a second set of plates for said coil bore, sequentially machining one side of each of said second plates with an outwardly, radially-spiraling groove extending in a clockwise direction from a corresponding point near its bore to a point near its outer perimeter that corresponds to the beginning point of the groove of each of said first plates, machining a short crossover slot through each of said second plates at the two end points of each of said spiral grooves in said second plates, machining a conductor pass-through hole in a bottom cover plate for said magnet, machining a conductor pass-through hole in a top cover plate for said magnet, each of said first, second and cover plates fabricated from the group consisting essentially of metal, ceramic and a reinforced polycarbonate plastic, threading said conductor from a supply spool through said hole in said top cover plate, through the crossover slot near the bore of one of said second plates, through the crossover slot near the outer perimeter of one of said first plates, through the crossover slots of additional pairs of second and first plates in the same manner as the above second and first plates were threaded until a desired number of such pairs of plates are threaded on said conductor, and finally threading said conductor through said hole in said bottom cover plate, then bringing said bottom cover plate and one of said first plates to a horizontal, flat winding table and clamping them on the face thereof, slowly rotating said table while at the same time drawing said conductor from said supply spool and pressing said conductor into the spiral groove of said clamped first plate and after it is wound full of conductor, stopping said table rotation, bringing one of said second plates to said winding table and clamping it on top of said wound first plate, rotating said table again while at the same time continuing drawing said conductor from said supply spool and pressing said conductor into the spiral groove of said clamped second plate until it is wound full of said conductor, and repeating said winding steps for each of said desired number of pairs of first and second plates until they are wound with said conductor, bringing said top cover plate and placing it on top of the last wound plate, and finally bolting all of said plates together to thus provide a finished magnet, said conductor passing through appropriate crossover slots in respective ones of said plates during said winding steps to provide said finished magnet with a continuous conductor without any splices.

2. The method set forth in claim 1, wherein said conductor is a superconductor.

3. The method set forth in claim 1, wherein said plates are fabricated from metal.

4. The method set forth in claim 1, wherein said plates are fabricated from a reinforced polycarbonate plastic.

5. The method set forth in claim 1, including the additional steps of machining a plurality of small holes in each of said first and second plates and said cover plates parallel to said bore and at matching locations in each plate prior to said threading steps, said small holes having a diameter slightly larger in size than the cross section of said conductor, to thus accommodate the cooling of said finished magnet during a subsequent operation thereof.

6. The method set forth in claim 1, wherein said conductor comprises at least two wound-in-hand conductors for pressing into each of said spiral grooves of each of said first and second plates during said winding steps.

* * * * *